United States Patent [19]

Merriman

[11] 4,130,271

[45] Dec. 19, 1978

[54] SYNTHETIC RESIN RATCHET WINCH

[76] Inventor: Franklin Merriman, 524 DeAnza Dr., Corona del Mar, Calif. 92625

[21] Appl. No.: 893,056

[22] Filed: Apr. 3, 1978

Related U.S. Application Data

[63] Continuation of Ser. No. 729,809, Oct. 5, 1976.

[51] Int. Cl.[2] ..... B66D 1/30

[52] U.S. Cl. ..... 254/150 R; 74/575; 192/46

[58] Field of Search ..... 254/150 R, 186 HC, 175.3, 254/175.7; 74/575, 577 S, 325; 192/41 A, 46, 92, 12 B; 81/60

[56] References Cited

U.S. PATENT DOCUMENTS

| | | | |
|---|---|---|---|
| 3,730,483 | 5/1973 | Newell | 254/150 R |
| 3,927,580 | 12/1975 | Fawcett | 254/150 R |

*Primary Examiner*—Duane A. Reger
*Assistant Examiner*—Kenneth W. Noland
*Attorney, Agent, or Firm*—Richard L. Gausewitz

[57] ABSTRACT

The synthetic resin ratchet winch has separate pawl plates which are easily and economically mass-producible, and which may be quickly replaced if broken. Each pawl plate comprises at least one pawl and an associated body. It is held against rotation, relative to an adjacent cap or base, by upper or lower bosses. The post for the drum is not formed integrally with the synthetic resin base, being instead inserted therein after molding. The bottom portion of the post is integral with an outwardly-extending flange or protuberant region.

8 Claims, 3 Drawing Figures

SYNTHETIC RESIN RATCHET WINCH

This is a continuation of application Ser. No. 729,809, filed Oct. 5, 1976.

BACKGROUND OF THE INVENTION

1. Field of the Invention

This invention relates to the field of ratchet winches for sailboats, etc.

2. Description of Prior Art

Ratchet winches for sailboats, etc., are conventionally formed either entirely or mostly of metal, being therefore heavy, relatively expensive, and subject to corrosion. Furthermore, metal winches are often complex, and they require lubrication. Because of these and other characteristics of metal winches, there exists a need for a relatively lightweight, simple and inexpensive winch formed primarily of self-lubricating synthetic resin. Attempts have been made to create synthetic resin winches, but are not known to have met with widespread commercial success. It is believed that such lack of commercial success may have resulted from the lack of strength of prior-art synthetic resin winches, and/or from the fact that such winches had more parts than does the winch of the present invention.

SUMMARY OF THE INVENTION

The winch includes a fixedly-anchored synthetic resin base on which is disposed a synthetic resin pawl plate. A post or shaft extends through the base and projects upwardly therefrom, there being a synthetic resin drum rotatably mounted on the post. Each end of the drum is recessed and formed with internal ratchet teeth, the lower ratchet teeth being operably associated with the pawls of the above-indicated pawl plate. The upper ratchet teeth are associated with one or more pawls of a second synthetic resin pawl plate, which plate is mounted below a synthetic resin cap.

The two pawl plates each comprise at least one pawl which is integral with a body portion of the plate. Such body portion is keyed to the adjacent base or cap, as by bosses or pins. The bosses serve as stops for the pawls.

The pawls are closely adjacent the ratchet teeth and are so oriented that loading of the pawls, caused by attempted rotation of the drum, creates compressive column stresses in the pawls, with minimal shear or bending stresses.

To hold the cap on the drum, a screw is threaded downwardly into the upper end of the post. The head of the screw is disposed in a metal insert in a recessed portion of the cap, beneath the inner end of an operating crank or handle.

DETAILED DESCRIPTION OF THE PREFERRED EMBODIMENT

Except for highly important differences specified below, the present winch is identical to the one disclosed by my U.S. Pat. No. 3,910,557, issued Oct. 7, 1975, for a Synthetic Resin Ratchet Winch. The specification and drawings of said patent are hereby incorporated by reference herein. For convenience, the reference numbers for the unchanged portions of the winch disclosed by said patent are also used in the present application.

THE PAWL PLATES

Figure 1:
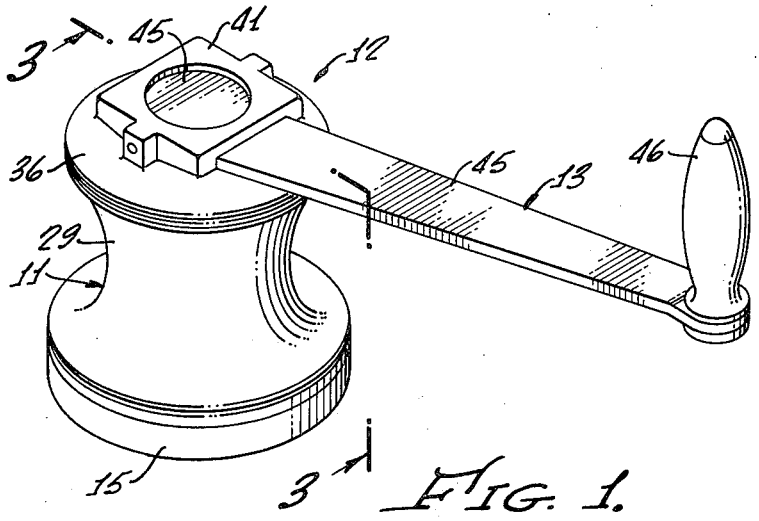
FIG. 1 is an isometric view of the synthetic resin ratchet winch.
Figure 2:
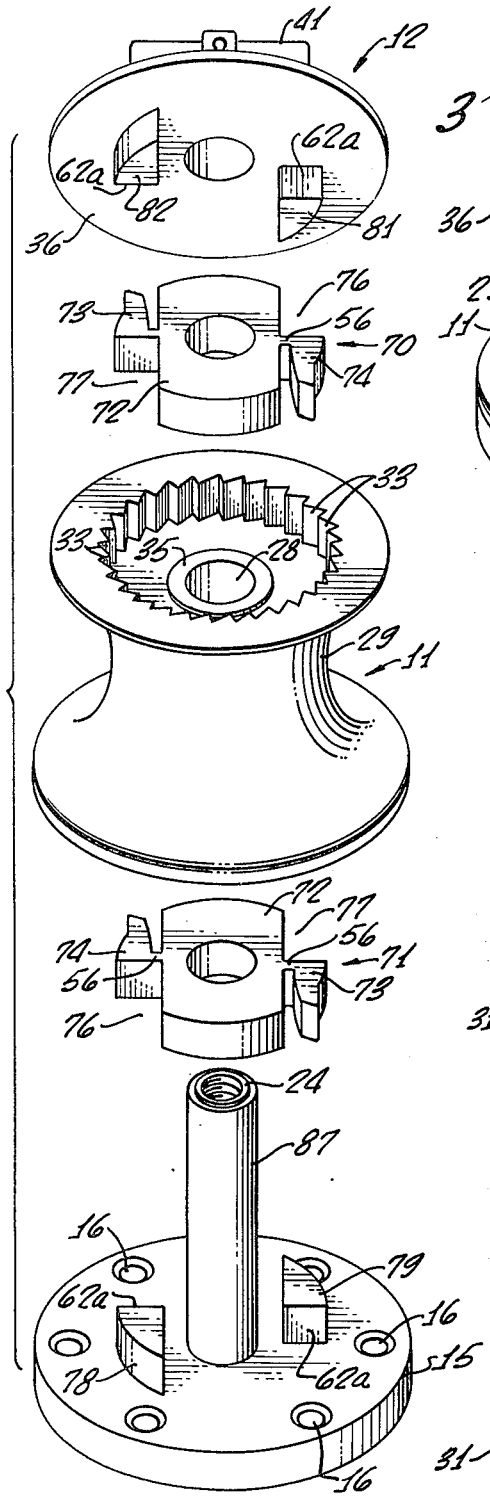
FIG. 2 is an exploded isometric view showing the various parts of the winch.
Figure 3:
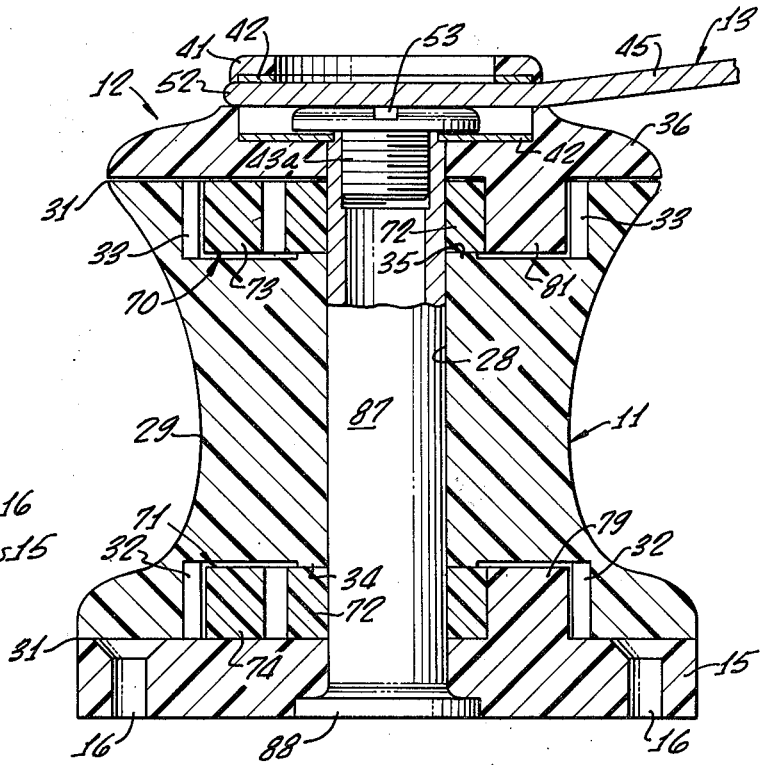
FIG. 3 is a vertical central sectional view, taken on line 3—3 of FIG. 1.

Referring to FIGS. 2 and 3, there are shown upper and lower pawl plates 70, 71 which are identical to each other, being molded of synthetic resin in a single mold. The upper pawl plate is, in FIGS. 2 and 3, shown as rotated 180° (about a vertical axis) relative to the lower pawl plate.

Each pawl plate has a body 72 which is integral with two pawls 73 and 74. Such pawls (and the means for and manner of flexural connection thereof to the body 72) are identical to pawls 18, 19, 38 and 39 (and beams 56) which were described at length in said U.S. Pat. No. 3,910,557, particularly relative to FIGS. 4 and 5 thereof.

Each body 72 is "cut out" at two regions 76, 77 respectively adjacent the pawl ends which are connected (through the flexural beams) with body 72. These "cut outs" are actually formed during molding, there being no cutting operation required.

The cut outs 76, 77 make it unnecessary to form slots adjacent the flexural beams 56. For this and other major reasons, molding of pawl plates 70, 71 is vastly more economical and satisfactory than molding of the pawls, etc., described in the cited patent.

The cut-out regions 76, 77 of lower pawl plate 71 are shaped to receive bosses 78, 79 of the synthetic resin base disc 15. Such bosses are molded integrally with such disc, and fit snugly into the cut-out regions of the pawl plate. Thus, each boss has a peripheral curved region (a portion of a cylinder) adapted to fit closely adjacent the ratchet teeth of the drum. It also has two sides related at a right angle, and which fit closely against (a) one face of body 72 and (b) the flexural beam 56 and the associated pawl end (one surface of such beam being co-planar with one surface of such pawl end).

Correspondingly, there are upper bosses 81, 82 which fit into cut-out regions 76, 77 of the upper pawl plate 70. Such bosses are molded integrally with synthetic resin disc 36.

The body 72 of each pawl plate 70, 71 is centrally apertured to receive the central post described below. When the lower pawl plate 71 is dropped over such post, and seated on base disc 15 with bosses 78, 79 in the respective cut-out regions 76, 77, such pawl plate 71 is effectively prevented from rotating (the base disc 15 being anchored on the deck of a boat). Only the lower pawls 73, 74 may move, within the limits permitted by flexural beams 56 and by bosses 78, 79.

Correspondingly, when cap 12 is mounted around the post and over the upper pawl plate 70, with bosses 81, 82 in position in the cut-out regions 76, 77, the plate 70 rotates with the cap 12 when handle or crank 13 is operated.

THE POST OR SHAFT

The central, vertical post or shaft 87 is illustrated as being a metal tube, but it may in some instances be a strong molded plastic element. The tube 87 has a cylindrical exterior surface, and is flared outwardly (as by spinning) at the bottom end to form a protuberant portion 88.

The synthetic resin disc 15 is centrally apertured to receive the post 87 in very snug, tight-fitting relationship. The bottom of the disc is so shaped as to receive the protuberant portion 88. Thus, the bottom of the post is flush with the bottom of the disc 15.

At its upper end, post 87 is internally threaded to receive the threaded shank of cap screw 43*a*. (The plug 24 and key 25, shown in the patent, are omitted).

SUMMARY

The various synthetic resin components are injection molded, and the post 87 is formed with its integral protuberant lower end 88. The post is inserted (tightly) upwardly through base disc 15 at the factory.

To mount on the deck of a boat, fasteners are passed through base openings 16 and through the deck. Then, lower pawl plate 71 is dropped over post 87, seating with its cut-out regions 76, 77 receiving bosses 78, 79.

Drum 11 is then dropped over the post, so that its recessed and internally-toothed lower end fits around the pawl plate 71 and its boss elements 78, 79. Then, the upper pawl plate is mounted in the recessed upper end of the drum, following which cap 12 is mounted thereover — again with the bosses in registry with the cut-out regions.

Cap screw 43*a* is then threaded into the upper post end, holding everything in place. The inner end of handle 13 is used, for this purpose, as a screwdriver.

Should a pawl or its associated flexural beam 56 break, it is a simple matter to replace a pawl plate in a very short time.

The bosses 78, 79, 81, 82 keep the pawl plates from rotating or otherwise shifting. The bosses further serve to directly absorb thrust (at stop surfaces 62*a*) when the pawls 73, 74 are loaded (compressed) in column as set forth in the cited patent, starting at column 5 of the patent, line 57.

The foregoing detailed description is to be clearly understood as given by way of illustration and example only, the spirit and scope of this invention being limited solely by the appended claims.

I claim:

1. A synthetic resin ratchet winch, which comprises:
(a) a synthetic resin base adapted to be anchored on the deck of a sailboat,
(b) a post extending upwardly from said base, in fixed relationship relative thereto,
(c) a first synthetic resin pawl plate mounted over said base,
said pawl plate not being integral with said base,
said pawl plate comprising a synthetic resin pawl which is integral with a synthetic resin flexural beam,
said beam being in turn integral with a synthetic resin body,
(d) a synthetic resin drum mounted rotatably on said post,
said drum having a recessed lower end which fits downwardly around said pawl plate,
there being internal teeth in said drum which cooperate with said pawl in permitting rotation of said drum in only a single direction relative to said pawl plate and said base,
(e) a synthetic resin cap mounted rotatably on said post above said drum,
(f) a second synthetic resin pawl plate mounted beneath said cap,
said second pawl plate not being integral with said cap,
said second pawl plate comprising a synthetic resin pawl which is integral with a synthetic resin flexural beam,
said beam being in turn integral with a synthetic resin body,
said drum having an internally-toothed recessed upper end which fits upwardly around said second pawl plate,
the teeth at the upper drum end cooperating with said pawl of said second pawl plate to permit rotation of said cap in only a single direction relative to said drum, and
(g) means to prevent rotation of said first pawl plate relative to said base, and to prevent rotation of said second pawl plate relative to said cap,
said means comprising boss elements removably received in recesses in the adjacent elements,
each of said pawl plates having a cut-out region adjacent its flexural beam and adjacent the pawl end which is connected to said flexural beam,
one of said boss elements being formed integrally on said base element and fitting into the cut-out region in said first pawl plate adjacent its beam and pawl end,
the other of said boss elements being formed integrally on said cap element and fitting into the cut-out region in said second pawl plate adjacent its beam and pawl end, said boss elements serving as stops for the adjacent pawls.

2. A ratchet winch for sailboats, which comprises:
(a) a synthetic resin base adapted to be anchored on the deck of a sailboat,
(b) a post extending upwardly from said base, in fixed relationship relative thereto,
(c) a synthetic resin drum mounted rotatably on said post,
said drum having a recess at the lower end thereof, there being internal teeth provided internally on said drum at said recess,
(d) synthetic resin pawl means disposed on said base,
said pawl means comprising a synthetic resin body,
said pawl means further comprising a synthetic resin pawl shaped to lock with said internal teeth to prevent rotation of said drum in one direction,
said pawl means further comprising a synthetic resin flexural beam extending between said body and said pawl,
said flexural beam being sufficiently flexible to flex and permit rotation of said drum in the direction opposite to said one direction, despite the presence of said teeth, and
(e) boss means provided fixedly on said base and extending upwardly therefrom to provide a stop for said pawl,
said boss means being positioned to be directly engaged by said pawl, when an attempt is made to rotate said drum in said one direction, so that the force is transmitted from one of said teeth through said pawl directly to said boss means for effective prevention of said rotation in said one direction,
said boss means also being positioned to permit movement of said pawl and said flexing of said beam when said drum is rotated in said direction opposite to said one direction.

3. The invention as claimed in claim 2, in which said body, flexural beam and pawl are all integral with each other.

4. The invention as claimed in claim 2, in which said body has an opening therein through which said post extends.

5. The invention as claimed in claim 2, in which a synthetic resin cap is mounted rotatably over said drum, in which pawl and tooth means are provided at the upper end of said drum to permit rotation of said cap in only one direction relative to said drum, and in which handle means are provided to effect rotation of said cap.

6. The invention as claimed in claim 5, in which said body, flexural beam and pawl are all integral with each other.

7. The invention as claimed in claim 5, in which said body has an opening therein through which said post extends.

8. The invention as claimed in claim 7, in which said body, flexural beam and pawl are all integral with each other, and in which there are a plurality of corresponding ones of said flexural beams and associated pawls integral with said body, the pawls being adapted to simultaneously engage different ones of said internal teeth.

* * * * *